US007081175B2

(12) United States Patent
Serizawa et al.

(10) Patent No.: US 7,081,175 B2
(45) **Date of Patent: *Jul. 25, 2006**

(54) GAS GENERATING COMPOSITION AND METHOD

(75) Inventors: Kazuya Serizawa, Handa (JP); Katsuhiko Takahashi, Aichi (JP)

(73) Assignee: NOF Corporation, Tokyo (JP)

( * ) Notice: Subject to any disclaimer, the term of this patent is extended or adjusted under 35 U.S.C. 154(b) by 226 days.

This patent is subject to a terminal disclaimer.

(21) Appl. No.: 10/801,691

(22) Filed: Mar. 17, 2004

(65) Prior Publication Data

US 2004/0216819 A1 Nov. 4, 2004

Related U.S. Application Data

(63) Continuation of application No. 09/856,849, filed as application No. PCT/JP99/05666 on Oct. 14, 1999, now abandoned.

(30) Foreign Application Priority Data

Oct. 6, 1999 (JP) ..... 11-285239

(51) Int. Cl.
*C06B 31/28* (2006.01)

(52) U.S. Cl. ..... 149/46

(58) Field of Classification Search ..... 149/46
See application file for complete search history.

(56) References Cited

U.S. PATENT DOCUMENTS

| | | | |
|---|---|---|---|
| 1,766,269 | A | 6/1930 | Thiecke et al. |
| 2,938,778 | A | 5/1960 | Linsk |
| 2,942,963 | A | 6/1960 | Burgwald |
| 3,720,553 | A | 3/1973 | Henerson |
| 3,886,008 | A | 5/1975 | Cook |
| 3,912,562 | A | 10/1975 | Garner |
| 4,140,562 | A | 2/1979 | Gualillo et al. |
| 4,911,077 | A | 3/1990 | Jphansson et al. |
| 5,320,382 | A | 6/1994 | Goldstein et al. |
| 5,589,661 | A | 12/1996 | Menke et al. |
| 5,596,168 | A | 1/1997 | Menke et al. |
| 6,009,810 | A | 1/2000 | Walsh |
| 6,033,500 | A | 3/2000 | Ito et al. |
| 6,059,906 | A | 5/2000 | Fleming et al. |
| 6,143,103 | A | 11/2000 | Ryder |
| 6,364,975 | B1 | 4/2002 | Fleming et al. |
| 6,368,432 | B1 | 4/2002 | Serizawa et al. |
| 6,505,562 | B1 | 1/2003 | Wu |

FOREIGN PATENT DOCUMENTS

| | | |
|---|---|---|
| EP | 0 576 326 A1 | 6/1993 |
| EP | 0 972 757 A | 1/2000 |
| JP | 58-79895 | 5/1983 |
| JP | 58-79896 | 5/1983 |
| JP | 07-267770 | 10/1995 |
| JP | 10-120484 | 5/1998 |
| JP | 11-092265 | 4/1999 |

*Primary Examiner*—Aileen Felton
(74) *Attorney, Agent, or Firm*—Nath & Associates PLLC; Harold L. Novick

(57) ABSTRACT

A gas generating composition includes ammonium nitrate as an oxidizing agent, microcrystalline carbon powder as a reducing agent, and a stabilizer for preventing decomposition of ammonium nitrate. The amounts of the ammonium nitrate, the carbon powder, and the stabilizer are 89 to 99 wt %, 1 to 6 wt %, and 0.2 to 6 wt %, respectively, with respect to the total amount of ammonium nitrate, microcrystalline carbon and stabilizer. The amount of microcrystalline carbon is preferably 1.5 to 6 wt % with respect to the amount of ammonium nitrate, and the amount of the stabilizer is preferably 10 to 200 wt % with respect to the amount of microcrystalline carbon powder. The stability of present composition is improved, especially, at high temperatures. The composition has an appropriate burn rate, produces substantially no carbon dioxide, and has a proper sensitivity. The present composition is easy to handle and is inexpensive.

31 Claims, 2 Drawing Sheets

GAS GENERATING COMPOSITION AND METHOD

This is a continuation of applications Ser. No. 09/856,849 filed May 25, 2000 now abandoned, which is a § 371 of International Application PCT/JP99/05666 filed Oct. 14, 1999, the contents of which are incorporated herein by reference in their entirety.

BACKGROUND OF THE INVENTION

The present invention relates to gas generating compositions that are loaded in a gas generating apparatus for inflating an airbag or in a pre-tensioner apparatus for retracting a seat belt, the airbag and the seat belt being mounted on, for example, a vehicle to provide protection for passengers of such vehicles.

Gas generating agents for inflating air bags of the type described above have been known that contain as major components sodium azide and various oxidizing agents. In recent years, however, there is an increasing need for a gas generating composition that is free of sodium azide, because of the strong toxicity of the compound and the difficulties in handling the compound. Also, a gas generating composition is needed that has following advantages: improved stability over time and a proper burn rate; non-production of carbon monoxide or combustion residues; improved handleability and significant gas generation; and low cost. To meet these requirements, significant effort has been made to develop gas generating agents that contain ammonium nitrate as a major component.

Japanese Unexamined Patent Publication No. 11-92265 discloses a gas generating composition containing carbon black or activated carbon and phase-stabilized ammonium nitrate. This composition is advantageous in terms of gas generation and combustion efficiencies and has a high burn rate.

Though the gas generating composition described in the above-mentioned publication is designed in consideration of various combustion-related properties such as the gas generating efficiency and the burn rate, less emphasis has been put on stability over time. Thus, the composition is not suitable with regard to the stability during storage before it is put to use, especially under high temperature conditions.

BRIEF SUMMARY OF THE INVENTION

The present invention is devised to address the above-mentioned problems associated with conventional gas generating compositions. Accordingly, it is an objective of the present invention to provide a gas generating composition that has improved stability over time, especially at higher temperatures, has a proper burn rate, produces substantially no carbon monoxide, has a proper sensitivity, is easy to handle, and is inexpensive.

To achieve the above-described objective, the present invention provides in one aspect a gas generating composition containing ammonium nitrate as an oxidizing agent, microcrystalline carbon powder as a reducing agent and a stabilizer. The amounts of the ammonium nitrate, the microcrystalline carbon, and the stabilizer are from 89 to 99 wt %, from 1 to 6 wt %, and from 0.2 to 6 wt %, respectively, with respect to the total amount of the ammonium nitrate, the microcrystalline carbon and the stabilizer.

In a preferred embodiment, the gas generating composition contains the microcrystalline carbon powder in an amount of from 1.5 to 6 wt % with respect to the amount of the ammonium nitrate and the stabilizer in an amount of from 10 to 200 wt % with respect to the amount of the microcrystalline carbon powder.

In another preferred embodiment of the gas generating composition, the ammonium nitrate has an average particle size of 1 to 1000 μm, and the microcrystalline carbon has an average particle size of 1 to 500 μm and has a specific surface of 5 to 1600 $m^2/g$, and the stabilizer has an average particle size of 0.1 to 500 μm.

BRIEF DESCRIPTION OF THE SEVERAL VIEWS OF THE DRAWING

These as well as other features of the present invention will become more apparent upon reference to the drawings in which.

DETAILED DESCRIPTION OF THE PREFERRED EMBODIMENTS

Figure 1:
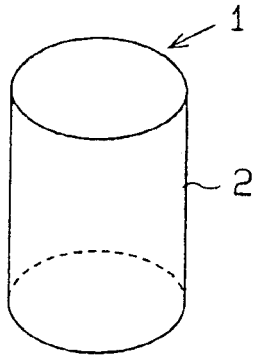
FIGS. 1(*a*) to 1(*h*) are perspective views showing various shapes of molded products of a gas generating composition according to the present invention.
Figure 1:
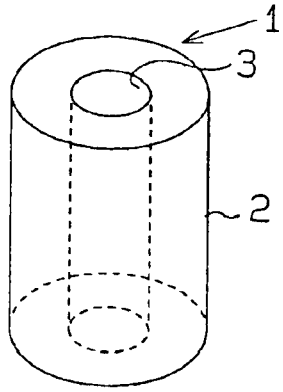
Figure 1:
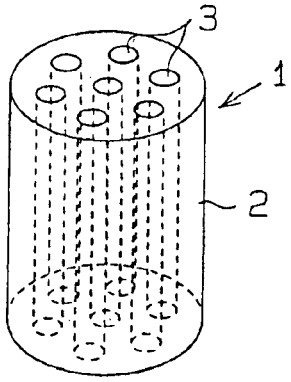
Figure 1:
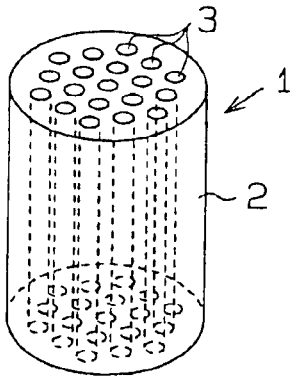
Figure 1:
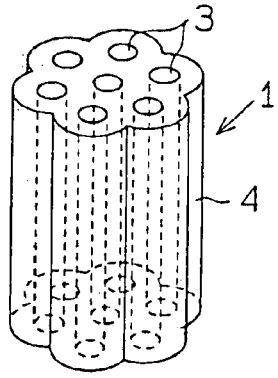
Figure 1:
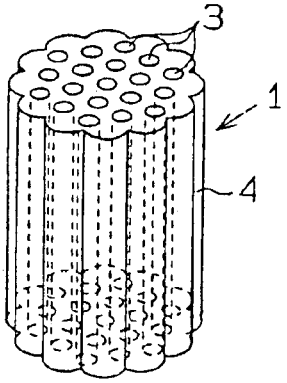
Figure 1:
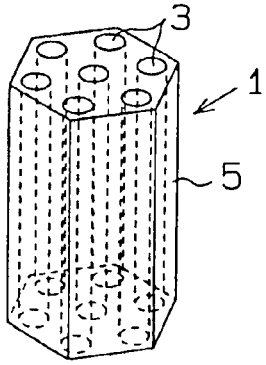
Figure 1:
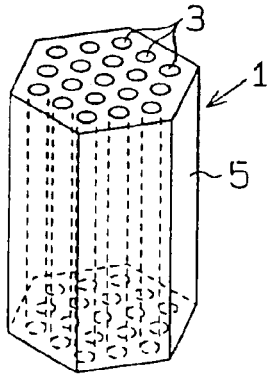

The preferred embodiments of the present invention will now be described with reference to the accompanying drawings.

A gas generating composition (also referred to as a gas generating agent, when necessary) includes ammonium nitrate as an oxidizing agent, microcrystalline carbon powder as a reducing agent, and a stabilizer. The amount of each component is 89 to 99 wt % for ammonium nitrate, 1 to 6 wt % for microcrystalline carbon and 0.2 to 6 wt % for the stabilizer, with respect to the total amount of the ammonium nitrate, the microcrystalline carbon powder, and the stabilizer.

Ammonium nitrate acts as an oxidizing agent and oxidizes microcrystalline carbon to produce gaseous nitrogen and carbon dioxide upon combustion of the gas generating agent. Preferably, the ammonium nitrate is provided in the form of powder in order to facilitate mixing with the other components and provide a high combustibility. The average particle size of the ammonium nitrate powder is 1 to 1000 μm, more preferably 1 to 500 μm in regard of mechanical properties and the combustibility of molded products formed of the gas producing agent, and even more preferably 1 to 200 μm.

While the average diameter of ammonium nitrate particles less than 1 μm makes the manufacturing of ammonium nitrate products difficult, the average diameter greater than 1000 μm makes it difficult to mix the ammonium nitrate product with a binder, which is required for making the molded products from the gas generating agent, so that the mechanical properties of the molded products may deteriorate and the burn rate may be decreased when the molded products are burned.

The ammonium nitrate may be phase-stabilized ammonium nitrate in which changes in the crystal structure occurring due to changes in temperature are reduced. The phase-stabilized ammonium nitrate can be obtained in the following manner. First, zinc oxide, nickel oxide, copper oxide, potassium bromide, potassium nitrate, or potassium perchlorate is added to molten ammonium nitrate melted in a melt bath heated to a predetermined temperature and the materials are mixed. The mixture is cooled in the melt bath while being stirred to form phase-stabilized ammonium nitrate. Alternatively, the molten material may be sprayed with the help of compressed air supplied from a compressor, following the mixing in the melt bath. This also results in phase-stabilized ammonium nitrate.

For compression molded products, when the amount of the binder is set to a relatively small amount of 2 to 3 wt %, the gas generating agent tends to crumble due to changes in the crystal structure of ammonium nitrate when subjected to a temperature change. Thus, it is desirable to use phase-stabilized ammonium nitrate in the production of compression molded products.

In contrast, in molded products made by extrusion molding using about 10 wt % of the binder, the surfaces of the ammonium nitrate particles are sufficiently covered by the binder so that the binder compensates for the changes in the crystal structure of ammonium nitrate that occur due to temperature changes, which prevents the gas generating agent from crumbling.

Accordingly, when it is desired to make molded products from the gas generating agent by extrusion molding, ordinary ammonium nitrate is preferably used rather than phase-stabilized ammonium nitrate. This allows the use of simpler gas generator filters and thus makes it possible to reduce the size of the gas generator. Further, generation of combustion residue is prevented.

Ammonium nitrate is known to have a significant hygroscopic property. In order to reduce the hygroscopic property, ammonium nitrate particles with coated surfaces are preferably used.

The coated ammonium nitrate particles are prepared in the following manner. First, an organic solvent and a coating agent are placed in a container and are heated to a temperature between 70° C. and 80° C. to dissolve the coating agent in the solvent. Ammonium nitrate is then added to the dissolved coating agent in the container, and the mixture is stirred until the temperature of the mixture is decreased to the ambient temperature. This results in ammonium nitrate particles with coated surfaces.

The coating agent may be any material that can prevent the ammonium nitrate particles from absorbing moisture when applied to the surfaces of the ammonium nitrate particles. For example, poly-glycol polymers such as polyethylene glycol, polyvinyl polymers and paraffin wax may be used. Of these, polyethylene glycol is most preferred in view of its high ability as a coating agent to keep the ammonium nitrate from absorbing moisture.

Considering the hygroscopic property of polyethylene glycol, polyethylene glycol with molecular weights of from 6000 to 20000 is still more preferred. Application of such coatings can prevent moisture absorption by the ammonium nitrate and thus facilitate handling of the ammonium nitrate. Furthermore, the coated ammonium nitrate has improved compatibility with binders that contributes to the mechanical properties of the molded products.

The content of ammonium nitrate is preferably 89 wt % to 99 wt %, more preferably 91 wt % to 98 wt % in view of the amount of gases generated by the gas generating composition and to substantially prevent the generation of carbon monoxide in the resultant gases, and still more preferably 93 wt % to 98 wt %, with respect to the total amount of the ammonium nitrate, the microcrystalline carbon powder, and the stabilizer.

When the amount of ammonium nitrate is less than 89 wt %, the amount of gases generated during combustion of the gas generating composition is decreased and carbon monoxide is produced. When the amount is greater than 99 wt %, the burn rate may be decreased and it may be difficult to sustain burning at lower pressures.

As used herein, a condition in which the generation of carbon monoxide is substantially prevented refers to the condition in which the concentration of carbon monoxide in the generated gas is 5000 ppm or less.

Next, microcrystalline carbon powder is described. Microcrystalline carbon powder is similar to graphite in its two-dimensional structure. In a first form of the microcrystalline carbon powder, carbon atoms are arranged at the corners of hexagons and are interconnected with each other to form a planar network structure. A plurality of such planar networks are arranged in parallel to one another in a layered fashion with each network equally spaced apart from adjacent networks. However, the carbon atoms in each planar network, or layer, are not completely aligned from one plane to the next in the direction perpendicular to the planar network or layer. In comparison, in a second form of the microcrystalline carbon powder, some of the carbon atoms at the corners of hexagons may be linked to adjacent carbon atoms in a random manner. This can cause distortion in the surface of the graphite layer. In either form, microcrystalline carbon powder can be considered as an aggregation of graphite-based microcrystallines that lacks structural integrity.

The microcrystalline carbon powder plays a role in the gas generating agent by acting as a reducing agent that reacts with an oxidizing agent, i.e., ammonium nitrate, to produce gaseous nitrogen, carbon dioxide, or water (water vapor). The microcrystalline carbon powder may include, but are not limited to, activated carbon, coke, animal charcoal, bone black, acetylene black, or carbon black. Of these, activated carbon is particularly preferred for the purpose of improving the combustibility of the gas generating agent.

While preferred starting materials for the production of activated carbon may include, but are not limited to, coconut shells, coal, and charcoal, activated carbon made from coconut shells is particularly preferred because of its small pore size.

A preferred activation method for producing activated carbon may be a gas activation in which gases such as water vapor, carbon dioxide, and air are used, or a chemical activation in which chemical agents such as zinc chloride and calcium chloride are used. While both of these methods may preferably be used, the gas activation is particularly preferred for the production of activated carbon since small pore size can be achieved in this approach.

The average particle size of the microcrystalline carbon powder is preferably from 0.1 to 500 μm, more preferably from 1 to 100 μm in terms of mechanical properties and the combustibility of the molded products of the gas generating composition, and even more preferably from 3 to 50 μm. An average particle sizes greater than 500 μm may reduce the burn rate of the molded products while an average particle size less than 0.1 μm may make it difficult to manufacture the products.

The specific surface of the microcrystalline carbon powder is preferably from 5 to 1600 $m^2/g$, more preferably from 10 to 1500 $m^2/g$ in view of mechanical properties and the combustibility of the molded products of the gas generating composition, and even more preferably from 50 to 1300 $m^2/g$. Specific surfaces greater than 1600 $m^2/g$ may make the manufacturing of the microcrystalline carbon powder difficult while specific surfaces less than 5 $m^2/g$ may reduce the burn rate of the molded products of the gas generating composition.

The amount of the microcrystalline carbon powder in the gas generating composition is preferably from 1 to 6 wt %, more preferably from 1 to 5 wt % for improving the combustibility of the products while substantially preventing the generation of carbon monoxide in the resulting gas, and still more preferably 1.5 to 5 wt % with respect to the total amount of the ammonium nitrate, the microcrystalline carbon powder and the stabilizer. Amounts less than 1 wt % may decrease the burn rate of the gas generating composition and make it difficult to sustain burning at lower pressures while amounts greater than 6 wt % may lead to generation of carbon monoxide upon combustion of the gas generating products.

The amount of the microcrystalline carbon powder is preferably 1.5 to 6 wt %, more preferably from 1.5 to 5.5 wt % for improving the combustibility of the products while substantially preventing the generation of carbon monoxide, and still more preferably from 1.5 to 5 wt % with respect to the amount of ammonium nitrate. Amounts less than 1.5 wt % may reduce the burn rate of the products and make it difficult to sustain burning at lower pressures while amounts greater than 6 wt % may lead to generation of carbon monoxide upon combustion of the gas generating composition.

Next, the stabilizers are described. The stabilizers act to enhance the stability of the gas generating agent made from ammonium nitrate and microcrystalline carbon powder over time, especially the stability over time at higher temperatures.

The stabilizers may include diphenyl urea, methyldiphenyl urea, ethyldiphenyl urea, diethyldiphenyl urea, dimethyldiphenyl urea, methylethyldiphenyl urea, diphenylamine, 2-nitrodiphenylamine, diphenyl urethane, ethylphenyl urethane, methylphenyl urethane, or resorcinol. Among these stabilizers, at least one selected from diphenylamine, resorcinol and diethyldiphenyl urea is preferred in view of the ability to prevent decomposition of ammonium nitrate. Of these, diphenylamine is most preferred, and resorcinol is secondly preferred, and diethyldiphenyl urea is thirdly preferred.

The average particle size of the stabilizer is preferably from 0.1 to 500 μm, more preferably from 1 to 100 μm in view of enhancing the stability of the gas generating agent over time, and still more preferably from 1 to 50 μm. Stabilizers with the average particle size of 500 μm or larger may not exhibit the desired effect of enhancing the stability of the gas generating agents over time. Average particle sizes less than 0.1 μm may make the manufacturing of the gas generating agent difficult.

The amount of the stabilizer is preferably from 0.2 to 6 wt %, more preferably from 0.2 to 4 wt % in view of improving the stability of the gas generating agents over time while substantially preventing generation of carbon monoxide upon combustion of the gas generating agents, and still more preferably from 0.2 to 3 wt % with respect to the total amount of the ammonium nitrate, the microcrystalline carbon powder, and the stabilizer. The stabilizer contained in an amount less than 0.2 wt % may not exhibit the desired effect of improving the stability of the gas generating agents over time. Amounts greater than 6 wt % may reduce the burn rate of the gas generating agents and lead to generation of carbon monoxide upon combustion.

The amount of the stabilizer is preferably from 10 to 200 wt %, and more preferably from 30 to 100 wt % for enhancing the stability of the gas generating agents over time while substantially preventing generation of carbon monoxide upon combustion of the gas generating agent, and still more preferably from 40 to 60 wt % with respect to the amount of microcrystalline carbon powder. The stabilizer contained in an amount less than 10 wt % may not exhibit the desired effect of improving the stability of the gas generating agent over time. Amounts of the stabilizer greater than 200 wt % may reduce the burn rate of the gas generating products and lead to generation of carbon monoxide upon combustion of the gas generating agents.

A high-energy compound may be added to the gas generating agents in order to further increasing the burn rate of the gas generating agents. Such high-energy compounds include RDX (trimethylene trinitroamine), HMX (tetramethylene tetranitroamine), PETN (pentaerythritol tetranitrate), TAGN (triaminoguanidinenitrate), and HN (hydrazine nitrate). Of these, RDX is most preferred considering reactivity with ammonium nitrate that acts as an oxidizing agent.

Average particle size of the high-energy compound is preferably from 1 to 500 μm, more preferably 1 to 100 μm in view of mechanical properties and the combustibility of the molded products of the gas generating agents, and still more preferably from 1 to 30 μm.

Average particle sizes less than 1 μm often make the manufacturing of the high-energy compounds difficult while average particle sizes greater than 500 μm may result in insufficient mixing of the high-energy compounds with a binder, so that the mechanical properties of the molded products may deteriorate and the desired effect of increasing the burn rate may not be obtained.

The amount of the high-energy compound in the gas generating composition is preferably 15 wt % or less, more preferably from 1 to 10 wt % for facilitating handling of the gas generating agent and enhancing the combustibility while substantially preventing the generation of carbon monoxide during the combustion of the gas generating agent, and still more preferably from 1 to 5 wt %. Amounts of the high-energy compound greater than 15 wt % may make the gas generating composition susceptible to mechanical impacts, thus making the products less handleable.

In manufacturing molded products, a binder may be preferably added to the gas generating composition to make the gas generating agent into granules (granularation). The binders include cellulose acetate, cellulose butylate, polyesters, polyethers, polyurethanes, nitrocellulose, poly (vinyl alcohol), glycidyl azide polymers, thermoplastic elastomers, and thermoset elastomers. A mixture of these binders may also be used.

The amount of the binder in the gas generating composition is preferably 25 wt % or less, more preferably from 6 to 20 wt % for improving mechanical properties and the combustibility of the molded products of the gas generating agents while substantially preventing generation of carbon monoxide during the combustion of the gas generating agent, and still more preferably from 8 to 15 wt %. When the binder is contained in an amount greater than 25 wt %, though the mechanical properties of the molded products of the gas generating agents are improved, proportion of the other components in the gas generating composition is decreased, resulting in a reduced combustibility, generation of carbon monoxide upon combustion of the gas generating agent, and a decreased burn rate.

A plasticizer may preferably be added to the gas generating agent in order to give plasticity to the gas generating agent and enhance moldability. The plasticizer may be any compound that has a good compatibility with the binder. In particular, the plasticizers include diester phthalate-based plasticizers such as dibutyl phthalate, dimethyl phthalate, and diethyl phthalate; fatty acid ester-based plasticizers such as phosphoric esters, triacetin, acetyltriethyl citrate; nitro-based plasticizers such as trimethylol ethane trinitrate, diethylene glycol dinitrate, triethylene glycol dinitrate, nitroglycerin, bis-2,2-dinitropropylacetal/formal; and glycidyl azide plasticizers.

The amount of the plasticizer in the gas generating composition is preferably 5 wt % or less, more preferably from 0.1 to 4 wt % for substantially preventing generation of carbon monoxide upon combustion of the gas generating agents, and still more preferably 0.1 to 3 wt %.

When the added amount of the plasticizer is greater than 5 wt %, while the effects of the plasticizer are significant, proportion of the other components in the gas generating composition is decreased, resulting in a reduced combustibility, and generation of carbon monoxide upon combustion of the gas generating agent.

Next, methods for manufacturing molded products from the gas generating agents by means of extrusion molding using organic solvents are described.

First, ammonium nitrate, microcrystalline carbon powder, the stabilizer, and optionally, the high-energy compound, the binder, and the plasticizer are weighed to provide predetermined amounts of each component.

Organic solvents used in extrusion molding may be any organic solvent that can completely dissolve the binder. In particular, the organic solvents include acetone, ethyl alcohol, ethyl acetate, and mixtures thereof. For example, the ratio of acetone to ethyl alcohol in the mixture of the two is preferably from 90:10 to 20:80 (acetone: ethyl alcohol) by weight. More preferably, the ratio of acetone to ethyl alcohol is from 80:20 to 40:60 wt % (acetone: ethyl alcohol) by weight in terms of the moldability of the gas generating composition, since the solvent evaporates so quickly that the manufacturing of the molded products of the gas generating agent may be difficult in case of 100% acetone whereas the solvent cannot completely dissolve the binder in case of 100% ethyl alcohol.

All of the materials are then placed in a kneader. The organic solvent is then added to form a homogenous mixture. The thoroughly mixed mixture is loaded in an extruder and a predetermined pressure is applied to extrude the mixture through a die. Thus, a molded product of the gas generating composition having a predetermined shape and size is obtained.

A molded product 1 of the gas generating agents may be shaped as a solid cylindrical body 2 as shown in FIG. 1(*a*), a cylindrical body 2 as shown in FIG. 1(*b*) having a longitudinal bore 3 extending therethrough, a cylindrical body 2 having seven through bores 3 as shown in FIG. 1(*c*), or a cylindrical body 2 having nineteen through bores 3 as shown in FIG. 1(*d*). Further, the molded product 1 may be shaped as a varied shape body 4 having seven through bores 3 as shown in FIG. 1(*e*), a varied shape body 4 having nineteen through bores 3 as shown in FIG. 1(*f*), a hexagonal body 5 having seven through bores 3 as shown in FIG. 1(*g*), and a hexagonal body 5 having nineteen through bores 3 as shown in FIG. 1(*h*).

In the molded products 1 of the gas generating agent shown in FIGS. 1(*c*) through 1(*h*), a line that passes through centers of the outermost through bores 3 describes a regular hexagon, and a line that passes through centers of three through bores that are adjacent to one another describes a regular triangle for all sets of the three triangles. In other words, the through bores 3 are equally spaced apart.

While the shape and size of the molded product 1 of the gas generating agent may vary considerably depending on intended applications, it generally has an outer diameter of about 0.5 mm to 50 mm and a length (which is referred to as an agent length, hereinafter) of about 0.5 mm to 50 mm. For example, a cylindrical body 2 as shown in FIG. 1(*b*), which has an outer diameter of 0.5 mm to 5 mm and an agent length of 0.5 mm to 5 mm and through which a bore having an inner diameter of 0.1 mm to 4 mm extends, may be used as a gas generating agent for use in pre-tensioners, which are required to activate and burn out very quickly, in particular, within 5 to 20 ms, upon collision of a vehicle.

The pre-tensioner device herein refers to a device that is mounted on a seat belt of a vehicle and in which the gas generating agent is ignited and burnt upon collision of the vehicle, and the resultant pressure causes the seat belt to retract to keep the body of a passenger from being thrown forward.

In view of the moldability and the gas generating rate of the gas generating agent, the molded product 1 of the gas generating agent preferably has a dimension with an outer diameter of 0.5 to 2 mm, an inner diameter of the through bore of 0.2 to 1 mm, and an agent length of 0.5 to 2 mm. Molding a product having a thickness of 0.1 mm or less as measured from the outer surface of the molded body to the inner surface of the bore, or having a length of less than 0.5 mm, may be difficult. Also, the rate at which the gas generating agent generates gas may be decreased and the performance of the gas generating agent may not be fully exploited when the thickness is greater than 1 mm, or when the length is greater than 5 mm.

For example, the molded product 1 of the gas generating agent for use with airbags, which are required to burn out at a rate that does not exceed that of the gas generating agent for pre-tentioners, in particular at a rate of 25 to 55 ms, may be those shown in FIGS. 1(*c*) through 1(*h*), having a dimension with an outer diameter of about 5 to 40 mm, an inner diameter of the bore of about 1 to 10 mm and an agent length of about 5 to 40 mm, or it may be that shown in FIG. 1(*b*) having a dimension with an outer diameter of about 3 to 10 mm, an inner diameter of the bore of about 1 to 8 mm and an agent length of about 2 to 10 mm. However, when the thickness is greater than 3 mm, the rate at which the gas generating agent generates gas decreases and the performance of the gas generating agent may not be fully exploited.

It is preferred to remove organic solvents including acetone, ethanol, or ethyl acetate, from the gas generating agent as much as possible since these organic solvents, when present in the gas generating agent in a significant amount, may lead to an insufficient combustion performance. In general, the amounts of organic solvents and water in the gas generating agent after drying are preferably 0.5 wt % or less and 1.0 wt % or less, respectively, more preferably 0.3 wt % or less and 0.5 wt % or less, respectively, in view of the handleability after molding, and still more preferably 0.1 wt % or less and 0.2 wt % or less, respectively. Amounts of the organic solvents greater than 0.5 wt %, or amounts of water greater than 1.0 wt % may cause the gas generating rate and the mechanical properties of the gas generating agent to deteriorate.

When a vehicle, such as an automobile, collides at a high speed, an igniting agent placed in the gas generating apparatus is ignited by an electrical or mechanical means when the impact is sensed, and the resulting flame ignites the gas generating agent to initiate burning. When the gas generating agent burns, ammonium nitrate reacts with the microcrystalline carbon powder to generate gaseous nitrogen ($N_2$) and carbon dioxide ($CO_2$) principally. As a result, the airbag is deployed.

The burn rate of the gas generating agent is from about 1 to 500 mm/sec. Burning rates less than 1 mm/sec are not desirable since the pressure in the airbag builds up too slowly. When the burn rate is greater than 500 mm/sec, the pressure in the airbag builds up too rapidly. This may cause problems such as bursting of the airbag, and the performance of the gas generating agent may not be fully employed.

The gas generating agent is stored in a gas generator mounted on vehicles for a prolonged period of time until the gas generator is activated. Accordingly, the gas generating agent may be subjected to high temperatures when the temperature within the vehicle rises. While ammonium nitrate in the gas generating agent is relatively less susceptible to decomposition at high temperatures, the presence of the microcrystalline carbon powder may accelerate the decomposition of ammonium nitrate.

Although underlying mechanisms of the decomposition of ammonium nitrate have not been fully understood, it is believed that the products resulting from the decomposition of ammonium nitrate itself (i.e., $NO_x$ such as $NO_2$) attack the intact ammonium nitrate to cause it to decompose. This reaction, known as autocatalysis, is thought to facilitate the decomposition of ammonium nitrate. Further, the decomposition products are absorbed onto the surfaces of the microcrystalline carbon powder, in particular, activated carbon, and facilitate oxidation of the activated carbon. As a result, heat is generated and temperature increased. This further accelerates the decomposition of ammonium nitrate.

However, the stabilizer contained in the gas generating agent captures the decomposition products of ammonium nitrate and disrupts the autocatalysis by the decomposition products. This suppresses the decomposition of ammonium nitrate. Specifically, the decomposed products are captured by benzene rings that are bound to heterogeneous atoms in stabilizers such as phenylamine or resorcinol.

Accordingly, decomposition of ammonium nitrate may be suppressed, enhancing the stability of the gas generating agent over time. Also, heat generation due to the absorption of the decomposition products onto the microcrystalline carbon powder can be reduced so that the decomposition of ammonium nitrate due to an increased temperature is suppressed. Consequently, the stability of the gas generating agent can be maintained over time.

Desired effects obtainable from the above-described embodiments are described in the following.

The gas generating composition as described in the above embodiments has an excellent stability over time, especially under a high temperature condition in which the agent is left for 400 hours at 107° C., for example, since the stabilizer captures the decomposition products of ammonium nitrate and thereby suppresses the decomposition of ammonium nitrate.

The present gas generating composition, which contains ammonium nitrate as well as microcrystalline carbon powder and the stabilizer in proper amounts, achieves appropriate burn rates.

The present gas generating composition, which contains ammonium nitrate, microcrystalline carbon powder, and the stabilizer in proportions that can provide a proper oxygen balance, produces substantially no carbon monoxide during the combustion of the gas generating composition.

The present gas generating composition, which consists essentially of ammonium nitrate, microcrystalline carbon powder and the stabilizer, does not contain any component that excessively increases its sensitivity so that it has a proper sensitivity and handling of the composition is easy.

The present gas generating composition, which consists of inexpensive ammonium nitrate in most part and contains small amounts of microcrystalline carbon powder and the stabilizer, can be manufactured in a less costly manner.

The present gas generating composition, which contains ammonium nitrate, microcrystalline carbon powder and the stabilizer in predetermined proportions, has an enhanced stability over time, especially at higher temperatures. It can also provide various properties such as proper burn rates, substantially no production of carbon monoxide, readiness in handling the agent owing to the proper sensitivity, and a reduction in the production cost, in a well-balanced manner.

The present gas generating composition, in which the amount of microcrystalline carbon powder is set to an amount of 1.5 to 6 wt % with respect to the total amount of the ammonium nitrate and the amount of the stabilizer is set to an amount of 10 to 200 wt % with respect to the total arrmunt of microcrystalline carbon powder, exhibits the activities of both microcrystalline carbon powder and the stabilizer in a synergetic manner. Accordingly, not only are the stability and the burn rate of the gas generating agent further increased but also a further suppression of the generation of carbon monoxide is achieved.

The present gas generating composition, in which the average particle sizes of the ammonium nitrate, the microcrystalline carbon powder, and the stabilizer are set to a size from 1 to 1000 μm, from 1 to 500 μm, and from 0.1 to 500 μm, respectively, and the specific surface of microcrystalline carbon powder is set to a value of 5 to 1600 $m^2/g$, facilitates the manufacturing of the molded products of the gas generating agent and enhances mechanical properties of the molded products.

EXAMPLES

The gas generating composition as described in the above embodiments will now be described in further detail by examples and comparative examples presented below.

Example 1

Figure 2:
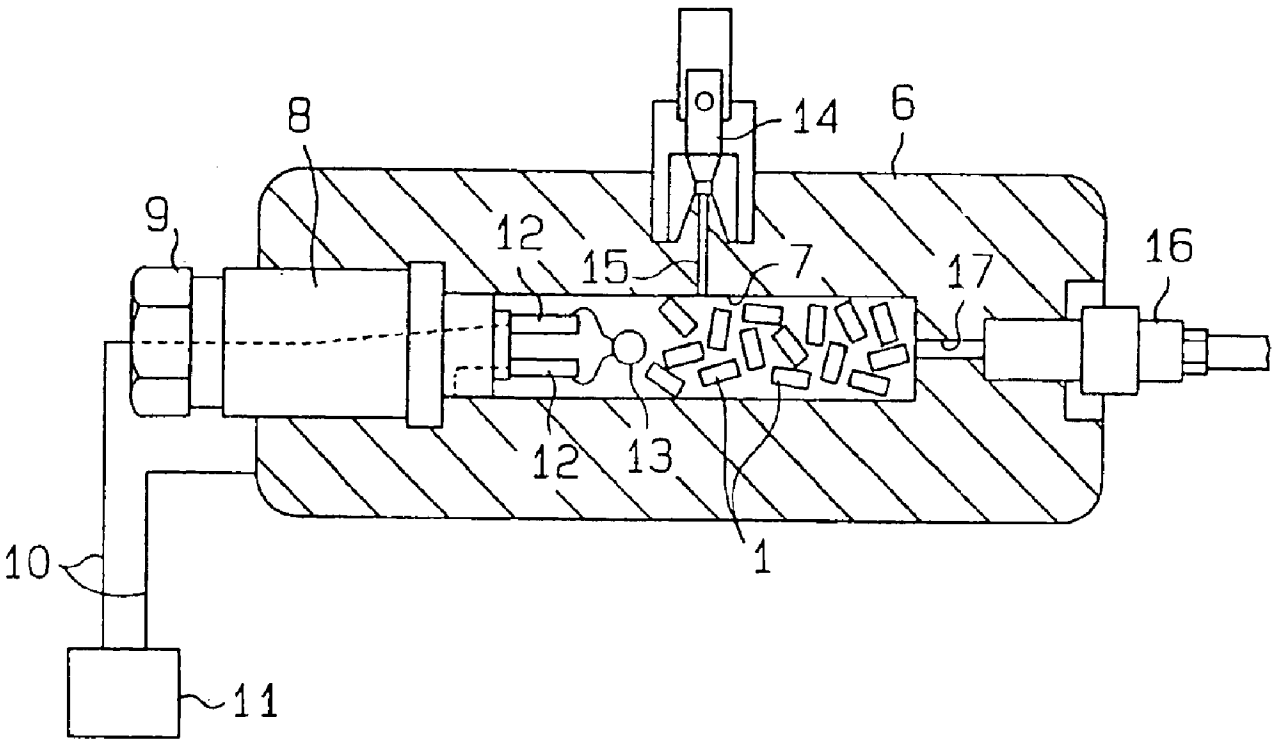
FIG. 2 is a cross-sectional view of a closed type combustion test apparatus used for testing of a combustion performance of the gas generating agent according to the present invention.

Ammonium nitrate particle with the average diameter of 15 μm, activated carbon with a specific surface of about 950 $m^2/g$, and diphenylamine particle with the average diameter of 20 μm were mixed so that the amounts of each component are 93.2 wt %, 4.5 wt %, and 2.3 wt %, respectively. The mixture was formed into cylindrically molded products with a diameter of 7 mm and an agent length of 3.5 mm, using a rotary tablet machine. Using such a so produced gas generating composition, the concentration of carbon monoxide in the resultant gas generated during combustion of the composition and the burn rate of the composition was determined by a closed type combustion test apparatus as shown in FIG. 2.

Further, the gas generating composition was tested for stability over time at 107° C. for 400 hours. The weight after the stability test was measured to determine a percent decrease by weight. Further, using the gas generating composition after the stability test, the concentration of carbon monoxide in the gas generated during combustion of the composition and the burn rate of the composition were determined by the closed type combustion test apparatus. The results are shown in Table. 1.

(Methods for Measuring Carbon Monoxide Concentration and Burn Rate.)

First, the closed type combustion test apparatus is described. As shown in FIG. 2, the apparatus includes a bomb body 6 in which a combustion chamber 7 having a predetermined volume is defined. The molded products 1 of the gas generating agent are loaded in the combustion chamber 7. Plugged into the bomb body 6 from the left side thereof as shown in FIG. 2 is a plug 8, which is removeably attached to the bomb body 6 by means of a bolt 9. An igniter 11 is also connected to the left end of the bomb body 6 via a connection line 10.

Attached to the plug 8 on an inner end surface thereof within the combustion chamber 7 are a pair of electrodes 12, of which the upper electrode 12 in FIG. 12 is connected to the connection line 10 and the lower electrode 12 is connected to the bomb body 6. A fusehead 13 is attached to the electrodes 12 via respective connection lines. The igniter 11 is triggered to ignite the fusehead 13 via the connection line 10 and the electrodes 12. This in turn ignites and burns the molded products 1 of the gas generating agent in the combustion chamber 7.

Provided on a side wall of the bomb body 6 is a ventilation valve 14 which communicates with the combustion chamber 7 via a sampling passage 15. The ventilation valve 14 is designed to allow sampling of the gas in the combustion chamber 7 for evaluation of the combustion characteristics of the gas.

Arranged on the right-side end of the bomb body 6 is a pressure converter 16 which communicates with the combustion chamber 7 via a communication passage 17. The pressure converter 16 allows the determination of the relationship between the length of time required for the sample to burn out and the combustion pressure.

The molded products 1 of the gas generating agent are loaded in the combustion chamber 7 while the plug 8 is removed so that the specific gravity of the loaded products is 0.1 g/ml. The plug 8 is then plugged in and the molded products 1 of the gas generating agent in the combustion chamber 7 are ignited by the igniter 11. After the molded products 1 of the gas generating agent have burned out, the resultant gas is collected from the ventilation valve 14. The concentration of carbon monoxide in the collected gas is determined by a gas chromatography.

The relationship between the length of time required for the molded products 1 of the gas generating agent to burn out and the combustion pressure was measured by a oscilloscope via the pressure converter 16 to determine the burn rate at a combustion pressure of 20.6 MPa.

(Methods of Heat-Aging Test at Elevated Temperatures.)

The gas generating composition was weighed and placed in a sample bottle. The bottle was then placed in an incubator conditioned to a temperature of 107° C. and was left for 400 hours. After the incubation period, the gas generating composition was taken out of the incubator and weighed.

(Methods for Evaluating Heat-Aging Test at Elevated Temperatures.)

In this test, the gas generating composition is evaluated to see if a predetermined requirement is met. The requirement is that the composition is not decomposed and the decrease in weight is 5% or less after being left for 400 hours in an atmosphere at 107° C.

Examples 2 Through 11

Gas generating agents having different compositions as shown in Tables 1 and 2 were prepared in the same manner as in Example 1. Characteristics of each composition were evaluated in the same manner as in Example. 1. The results are shown in Tables 1 and 2.

TABLE 1

| | | Stability before heat-aging test | | Stability after heat-aging test | | |
|---|---|---|---|---|---|---|
| # Example | Composition (wt %) | CO conc. in the resultant gas (ppm) | Burn rate (mm/sec) | CO conc. in the resultant gas (ppm) | Burn rate (mm/sec) | decrease in weight (%) |
| 1 | ammonium nitrate 93.2<br>activated carbon 4.5<br>diphenylamine 2.3 | 0 | 23.5 | 0 | 21.2 | 0.8 |
| 2 | ammonium nitrate 93.2<br>activated carbon 4.5<br>resorcinol 2.3 | 0 | 22.9 | 0 | 20.2 | 1.2 |
| 3 | ammonium nitrate 93.2<br>activated carbon 4.5<br>diethyldiphenyl urea 2.3 | 0 | 24.4 | 0 | 21.6 | 1.9 |
| 4 | ammonium nitrate 93.0<br>activated carbon 2.0<br>diphenylamine 5.0 | 1700 | 15.8 | 1800 | 14.8 | 0.3 |

TABLE 1-continued

| # Example | Composition (wt %) | Stability before heat-aging test: CO conc. in the resultant gas (ppm) | Stability before heat-aging test: Burn rate (mm/sec) | Stability after heat-aging test: CO conc. in the resultant gas (ppm) | Stability after heat-aging test: Burn rate (mm/sec) | Stability after heat-aging test: decrease in weight (%) |
|---|---|---|---|---|---|---|
| 5 | ammonium nitrate 93.2<br>carbon black 4.5<br>diphenylamine 2.3 | 0 | 18.3 | 0 | 16.1 | 0.4 |
| 6 | ammonium nitrate 93.0<br>carbon black 2.0<br>diphenylamine 5.0 | 1700 | 12.1 | 1800 | 11.0 | 0.2 |
| 7 | ammonium nitrate 98.0<br>activated carbon 1.3<br>diphenylamine 0.7 | 0 | 12.5 | 0 | 12.4 | 0.5 |
| 8 | ammonium nitrate 93.0<br>activated carbon 5.7<br>diphenylamine 1.3 | 2000 | 23.0 | 2700 | 19.4 | 1.2 |
| 9 | ammonium nitrate 95.1<br>activated carbon 4.5<br>diphenylamine 0.4 | 0 | 22.1 | 2900 | 18.9 | 3.6 |

Example 12

89.3 wt % of ammonium nitrate having an average diameter of 15 μm, 1.8 wt % of activated carbon having a specific surface of about 950 $m^2/g$, 0.9 wt % of diphenylamine, and 8.0 wt % of cellulose acetate were mixed to obtain a mixture. The mixture was added 50 wt % of ethyl acetate and thoroughly mixed with a Werner kneader. The Werner kneader is equipment that performs mixing and stirring by means of stirring blades attached to a rotary shaft extending horizontally.

The resulting mixture was then loaded in an extruder. The extruder is equipped with a 3.5 mm die and a 2.2 mm pin so that, when a pressure is applied to the mixture, it is extruded through the die and is shaped into a molded product of the gas generating agent having a bore extending therethrough. The molded product was cut into 4.0 mm lengths which were then dried to give granules of the gas generating composition.

The granular gas generating composition so obtained was evaluated in the same manner as in Example 1. The results are shown in Table 2 below.

Examples 13 Through 15

Gas generating agents having different compositions as shown in Table 2 were prepared in the same manner as in Example 13. Characteristics of each composition were evaluated as in Example 13. The results are shown in Table 2.

TABLE 2

| # Example | Composition (wt %) | Stability before heat-aging test: CO conc. in the resultant gas (ppm) | Stability before heat-aging test: Burn rate (mm/sec) | Stability after heat-aging test: CO conc. in the resultant gas (ppm) | Stability after heat-aging test: Burn rate (mm/sec) | Stability after heat-aging test: decrease in weight (%) |
|---|---|---|---|---|---|---|
| 10 | ammonium nitrate 88.9<br>activated carbon 4.0<br>RDX 5.0<br>diphenylamine 2.1 | 0 | 27.8 | 0 | 25.8 | 0.7 |

TABLE 2-continued

| # Example | Composition (wt %) | Stability before heat-aging test: CO conc. in the resultant gas (ppm) | Stability before heat-aging test: Burn rate (mm/sec) | Stability after heat-aging test: CO conc. in the resultant gas (ppm) | Stability after heat-aging test: Burn rate (mm/sec) | Stability after heat-aging test: decrease in weight (%) |
|---|---|---|---|---|---|---|
| 11 | ammonium nitrate 89.4<br>activated carbon 1.6<br>RDX 5.0<br>diphenylamine 4.0 | 3400 | 14.7 | 3500 | 13.8 | 0.2 |
| 12 | ammonium nitrate 89.3<br>activated carbon 1.8<br>cellulose acetate 8.0<br>diphenylamine 0.9 | 0 | 12.8 | 0 | 11.2 | 0.7 |
| 13 | ammonium nitrate 89.3<br>activated carbon 1.8<br>cellulose acetate 8.0<br>resorcinol 0.9 | 0 | 12.7 | 0 | 10.4 | 1.4 |
| 14 | ammonium nitrate 89.3<br>carbon black 1.8<br>cellulose acetate 8.0<br>diethyldiphenyl urea 0.9 | 0 | 13.7 | 0 | 11.1 | 1.7 |
| 15 | ammonium nitrate 85.0<br>activated carbon 1.3<br>RDX 5.0<br>cellulose acetate 8.0<br>diphenylamine 0.7 | 0 | 15.7 | 0 | 13.0 | 0.8 |

Comparative Examples 1 Through 12

Gas generating agents having different compositions as shown in Tables 3 and 4 were prepared as in Example 1 for Comparative examples 1 through 10 and as in Example 12 for Comparative examples 11 and 12. Characteristics of each composition were evaluated as in Example 1. The results are shown in Tables 3 and 4.

TABLE 3

| # Comp. Example | Composition (wt %) | Stability before heat-aging test: CO conc. in the resultant gas (ppm) | Stability before heat-aging test: Burn rate (mm/sec) | Stability after heat-aging test: CO conc. in the resultant gas (ppm) | Stability after heat-aging test: Burn rate (mm/sec) | Stability after heat-aging test: decrease in weight (%) |
|---|---|---|---|---|---|---|
| 1 | ammonium nitrate 100.0 | 0 | 2.0 | 0 | 1.8 | 0.3 |
| 2 | ammonium nitrate 97.7<br>diphenylamine 2.3 | 0 | 1.9 | 0 | 1.9 | 0.1 |
| 3 | ammonium nitrate 93.1<br>activated carbon 6.9 | 0 | 28.0 | — | — | decomposed during test |

TABLE 3-continued

| # Comp. Example | Composition (wt %) | Stability before heat-aging test: CO conc. in the resultant gas (ppm) | Stability before heat-aging test: Burn rate (mm/sec) | Stability after heat-aging test: CO conc. in the resultant gas (ppm) | Stability after heat-aging test: Burn rate (mm/sec) | Stability after heat-aging test: decrease in weight (%) |
|---|---|---|---|---|---|---|
| 4 | ammonium nitrate 93.1<br>carbon black 6.9 | 0 | 20.3 | 5400 | 13.2 | 9.5 |
| 5 | ammonium nitrate 93.1<br>activated carbon 6.8<br>diphenylamine 0.1 | 0 | 27.2 | — | — | decomposed during test |
| 6 | ammonium nitrate 92.4<br>activated carbon 1.5<br>diphenylamine 6.1 | 5400 | 12.1 | 5500 | 11.6 | 0.3 |
| 7 | ammonium nitrate 93.1<br>carbon black 6.8<br>diphenylamine 0.1 | 0 | 20.5 | 4900 | 15.3 | 8.8 |
| 8 | ammonium nitrate 92.4<br>carbon black 1.5<br>diphenylamine 6.1 | 5400 | 10.9 | 5600 | 10.3 | 0.2 |
| 9 | ammonium nitrate 88.9<br>activated carbon 6.0<br>RDX 5.0<br>diphenylamine 0.1 | 0 | 29.2 | — | — | decomposed during test |

Comparative Examples 13 and 14

Gas generating agents, each of which contains phase-stabilized ammonium nitrate and activated carbon or carbon black in compositions shown in Table. 4, were prepared as in Example 1. The phase-stabilized ammonium nitrate was prepared by mixing 85 wt % of ammonium nitrate with 15 wt % of potassium nitrate in a melt bath and then spraying the molten material with compressed air supplied from a compressor. Characteristics of each composition were evaluated as in Example 1. The results are shown in Table 4.

TABLE 4

| # Comp. Example | Composition (wt %) | Stability before heat-aging test: CO conc. in the resultant gas (ppm) | Stability before heat-aging test: Burn rate (mm/sec) | Stability after heat-aging test: CO conc. in the resultant gas (ppm) | Stability after heat-aging test: Burn rate (mm/sec) | Stability after heat-aging test: decrease in weight (%) |
|---|---|---|---|---|---|---|
| 10 | ammonium nitrate 87.4<br>activated carbon 1.5<br>RDX 5.0<br>diphenylamine 6.1 | 5600 | 14.7 | 5800 | 13.8 | 0.2 |
| 11 | ammonium nitrate 89.3<br>activated carbon 2.6<br>cellulose acetate 8.0<br>diphenylamine 0.1 | 0 | 13.1 | 5100 | 9.8 | 10.2 |

TABLE 4-continued

| # Comp. Example | Composition (wt %) | Stability before heat-aging test | | Stability after heat-aging test | | |
|---|---|---|---|---|---|---|
| | | CO conc. in the resultant gas (ppm) | Burn rate (mm/sec) | CO conc. in the resultant gas (ppm) | Burn rate (mm/sec) | decrease in weight (%) |
| 12 | ammonium nitrate 85.0 activated carbon 1.9 RDX 5.0 cellulose acetate 8.0 diphenylamine 0.1 | 0 | 17.0 | 6000 | 13.1 | 9.8 |
| 13 | reduced phase transition ammonium nitrate 92.2 activated carbon 7.8 | 0 | 32.8 | — | — | decomposed during test |
| 14 | reduced phase transition ammonium nitrate 92.2 carbon black 7.8 | 0 | 21.8 | — | — | decomposed during test |

The following findings have been made from the results shown in Tables 1 to 4.

As shown in Comparative example 1, while ammonium nitrate alone did not present any significant problem with respect to carbon monoxide concentration and stability over time, its burn rate was too low to be used as a gas generating agent, suggesting the necessity to add microcrystalline carbon powder for improving the effect of the gas generating agent.

As can be seen in Comparative example 2, when diphenylamine was added to ammonium nitrate, the burn rate still remained excessively low while the decrease in weight was 0.1% and stability over time was improved.

In Example 1, in which activated carbon and diphenylamine as a stabilizer was added to ammonium nitrate, the gas generating agent did not decompose after heat-aging test and the decrease in weight was 0.8%. In contrast, the gas generating agent decomposed during the heat-aging test in the case of Comparative example 3, which did not contain a stabilizer. This implies a significant contribution of stabilizers to stability over time.

In Example 5 where carbon black was used as the microcrystalline carbon powder and a stabilizer was blended, the decrease in weight was 0.4%. Also, no significant increase in the carbon monoxide concentration was observed, nor was any significant decrease in the burn rate observed. In contrast, Comparative example 4 containing no stabilizer showed a decrease in weight of as much as 9.5 % after the heat-aging test, a significant increase in the carbon monoxide concentration, and a significant decrease in the burn rate.

When the test results of Examples 1 to 3 are compared, it is shown that the stabilizers have an ability to enhance the stability, which decreases in the order of diphenylamine, resorcinol, and diethyldiphenyl urea.

In all of Examples in which the amount of the stabilizer was from 0.2 to 6 wt % with respect to the total amount of the ammonium nitrate, the microcrystalline carbon powder and the stabilizer, the concentration of carbon monoxide in the resultant gas did not exceed 4000 ppm and the burn rate was appropriate. Also, sufficient performance was maintained after the heat-aging test. It is noted that, when the amount of the diphenylamine stabilizer deviated from the preferred range of 10 to 200 wt % with respect to the amount of microcrystalline carbon powder (i.e., Examples 4, 6, 9 and 11), one or more of the performances including the carbon monoxide concentration in the resultant gas, the burn rate, and the decrease in weight decreased.

In cases where the amount of the stabilizer was greater than 6 wt % with respect to the total amount of ammonium nitrate, microcrystalline carbon powder and the stabilizer (i.e., Comparative examples 6, 8 and 10), the carbon monoxide concentration in the resultant gas was increased to 5000 ppm or above while no significant problem was observed in regard of the burn rate and stability over time.

In cases where the amount of the stabilizer was 0.2 wt % or less with respect to the total amount of ammonium nitrate, microcrystalline carbon powder and the stabilizer (i.e., Comparative examples 5, 7, 9, 11 and 12), the decrease in weight may become exceedingly large, or the gas generating agent may decompose, or the carbon monoxide concentration in the resultant gas may become exceeding large after the heat-aging test, while no significant problem was observed in regard of the carbon monoxide concentration in the resultant gas and the burn rate prior to the heat-aging test.

Also, it has been shown that addition of high energy substances may further increase the burn rate and that addition of binders may enhance the mechanical properties of the molded products, facilitating handling of the gas generating agent.

In cases where phase-stabilized ammonium nitrate was used (i.e., Comparative examples 13 and 14), while no significant problem was observed in regard of the carbon monoxide concentration in the resultant gas and the burn rate, the gas generating agent decomposed after the heat-aging test and the stability over time proved to be lower than that of the typical ammonium nitrate.

When the ammonium nitrate is the phase-stabilized ammonium nitrate, it is possible to prevent the alteration in the crystalline structure of ammonium nitrate due to high temperature and prevent the gas generating agent from crumbling.

When the gas generating agent contains the high energy substance, the burn rate of the gas generating agent is increased and a larger degree of freedom is provided in designing molded products of the gas generating agent. This facilitates manufacturing of such products.

When the gas generating product contains the binder and the plasticizer, manufacturing of the molded products of the gas generating agent is facilitated and the mechanical properties of the gas generating agent are enhanced.

Alternatively, the gas generating agent may be formed into a cylindrical body with an outer diameter of 5 to 40 mm and a length of 5 to 40 mm which has 7 or 19 substantially equally spaced bores extending longitudinally therethrough. The bore may have an inner diameter of 1 to 10 mm, and the thickness from a surface of the cylindrical body to the bore may be 3 mm or less. Alternatively, the gas generating agent may be formed into a cylindrical body with an outer diameter of 3 to 10 mm and a length of 2 to 10 mm which has a bore extending longitudinally at the center thereof. The bore may have a diameter of 1 to 8 mm, and the thickness from a surface of the cylindrical body to the bore may be 3 mm or less. This makes it possible to form the gas generating agent into a shape that is suitable for use in an airbag and can readily be loaded in a gas generator so that the ability as a gas generating agent for an airbag can be effectively exploited.

Alternatively, the gas generating composition may be formed into a cylindrical body which has an outer diameter of 0.5 to 5 mm and a length of 0.5 to 5 mm and through which a bore extends longitudinally at the center of the cylindrical body. The bore may have a diameter of 0.1 to 4 mm, and the thickness from a surface of the cylindrical body to the bore may be 1 mm or less. This makes it possible to form the gas generating agent into a shape that is suitable for use in a pre-tensioner and can readily be loaded in a gas generator so that the ability as a gas generating agent for a pre-tensioner can be effectively exploited.

An organic solvent may be added to the gas generating composition to make it into a block, which is then extruded into a desired shape by an extruder. This makes it possible to easily and efficiently make the gas generating agent with a desired shape.

The stabilizer may be at least one selected from the group consisting of diphenylamine, resorcinol, and diethyldiphenyl urea. This ensures an excellent stability over time, in particular, the stability over time at elevated temperatures.

As has been described, the gas generating composition of the present invention has an improved stability over time, especially, at elevated temperatures. It also has an appropriate burn rate, produces substantially no carbon dioxide, has a proper sensitivity and is easy to handle. Further, manufacturing of the gas generating composition of the present invention is less costly.

What is claimed is:

1. A gas generating composition for use with an airbag device or a seat belt pretensioner apparatus, comprising:

ammonium nitrate as an oxidizing agent;

microcrystalline carbon powder as a reducing agent, wherein the microcrystalline carbon powder is activated carbon having an average particle size of 0.1 to 500 μm and having a specific surface of 5 to 1600 $m^2/g$; and a stabilizer, wherein the amounts of the ammonium nitrate, the microcrystalline carbon, and the stabilizer are from 89 to 99 wt %, from 1 to 6 wt %, and from 0.2 to 6 wt %, respectively, with respect to the total amount of the ammonium nitrate, the microcrystalline carbon and the stabilizer.

2. The gas generating composition as recited in claim 1, wherein the amount of the microcrystalline carbon is from 1.5 to 6 wt % with respect to the amount of the ammonium nitrate, and the amount of the stabilizer is from 10 to 200 wt % with respect to the amount of the microcrystalline carbon.

3. The gas generating composition as recited in claim 1, wherein the ammonium nitrate has an average particle size of 1 to 1000 μm, and the stabilizer has an average particle size of 0.1 to 500 μm.

4. The gas generating composition as recited in claim 1, wherein the ammonium nitrate is phase-stabilized ammonium nitrate.

5. The gas generating composition as recited in claim 1, wherein the gas generating composition further comprises a high energy substance.

6. The gas qenerating composition as recited in claim 1, wherein the gas generating composition further comprises a binder and a plasticizer.

7. The gas generating composition as recited in claim 1, wherein the gas generating composition is formed into a cylindrical body that has an outer diameter of 5 to 40 mm and a length of 5 to 40 mm and has 7 or 19 substantially equally spaced bores with an inner diameter of 1 to 10 mm extending longitudinally therethrough, and the thickness from a surface of the cylindrical body to the bore is 3 mm or less.

8. The gas generating composition as recited in claim 1, wherein the gas generating composition is molded into a cylindrical body that has an outer diameter of 3 to 10 mm and a length of 2 to 10 mm and has a bore with an inner diameter of 1 to 8 mm extending longitudinally at the center thereof, and the thickness from a surface of the cylindrical body to the bore is 3 mm or less.

9. The gas generating composition as recited in claim 1, wherein the gas generating composition is molded into a cylindrical body that has an outer diameter of 0.5 to 5 mm and a length of 0.5 to 5 mm and has a bore with an inner diameter of 0.1 to 4 mm extending longitudinally at the center thereof, and the thickness from a surface of the cylindrical body to the bore is 1 mm or less.

10. The gas generating composition as recited in claim 1, wherein the stabilizer is at least one selected from the group consisting of diphenylamine, resorcinol, and diethyldiphenyl urea.

11. The gas generating composition as recited in claim 1, wherein the activated carbon has an average particle size of 1 to 100 μm and has a specific surface of 10 to 1500 $m^2/g$.

12. The gas generating composition as recited in claim 1, wherein the activated carbon has an average particle size of 3 to 50 μm and has a specific surface of 50 to 1300 $m^2/g$.

13. A gas generating composition for use with an airbag device or a seat belt pretensioner apparatus, essentially consisting of:

ammonium nitrate as an oxidizing agent;

activated carbon having an average particle size of 0.1 to 500 μm and having a specific surface of 5 to 1600 $m^2/g$ as a reducing agent; and a stabilizer, wherein the amounts of the ammonium nitrate, the activated carbon, and the stabilizer are from 89 to 99 wt %, from 1 to 6 wt %, and from 0.2 to 6 wt %, respectively, with respect to the total amount of the ammonium nitrate, the activated carbon and the stabilizer.

14. The gas generating composition as recited in claim 13, wherein the activated carbon has an average particle size of 3 to 50 μm and has a specific surface of 50 to 1300 $m^2/g$.

15. The gas generating composition as recited in claim 13, wherein the stabilizer is at least one selected from the group consisting of diphenylamine, resorcinol, and diethyldiphenyl urea.

16. A gas generating composition for use with an airbag device or a seat belt pretensioner apparatus essentially consisting of:

ammonium nitrate as an oxidizing agent;

activated carbon having an average particle size of 0.1 to 500 μm and having a specific surface of 5 to 1600 $m^2/g$ as a reducing agent; and a stabilizer, wherein the amounts of the ammonium nitrate, the activated carbon, and the stabilizer are from 89 to 99 wt %, from 1 to 6 wt %, and from 0.2 to 6 wt %, respectively, with respect to the total amount of the ammonium nitrate, the activated carbon and the stabilizer, thereby the gas generating composition produces substantially no carbon monoxide when burned.

17. The gas generating composition as recited in claim 16, wherein the activated carbon has an average particle size of 3 to 50 μm and has a specific surface of 50 to 1300 $m^2/g$.

18. The gas generating composition as recited in claim 16, wherein the stabilizer is at least one selected from the group consisting of diphenylamine, resorcinol, and diethyldiphenyl urea.

19. A gas generating composition for use with an airbag device or a seat belt pretensioner apparatus essentially consisting of:

ammonium nitrate as an oxidizing agent;

activated carbon having an average particle size of 0.1 to 500 μm and having a specific surface of 5 to 1600 $m^2/g$ as a reducing agent;

a high-energy compound selected from the group consisting of trimethylene trinitroamine, tetramethylene tetranitroamine, pentaerythritol tetranitrate, triaminoguanidinenitrate), and hydrazine nitrate; and a stabilizer, wherein the amounts of the ammonium nitrate, the activated carbon, and the stabilizer are from 89 to 99 wt %, from 1 to 6 wt %, and from 0.2 to 6 wt %, respectively, with respect to the total amount of the ammonium nitrate, the activated carbon and the stabilizer, thereby the gas generating composition produces substantially no carbon monoxide when burned.

20. The gas generating composition as recited in claim 19, wherein the activated carbon has an average particle size of 3 to 50 μm and has a specific surface of 50 to 1300 $m^2/g$.

21. The gas generating composition as recited in claim 19, wherein the stabilizer is at least one selected from the group consisting of diphenylamine, resorcinol, and diethyldiphenyl urea.

22. The gas generating composition as recited in claim 19, wherein the amount of the high-energy compound in the gas generating composition is 15 wt % or less.

23. A gas generating composition for use with an airbag device or a seat belt pretensioner apparatus essentially consisting of:

ammonium nitrate as an oxidizing agent;

activated carbon having an average particle size of 0.1 to 500 μm and having a specific surface of B to 1600 $m^2/g$ as a reducing agent;

a binder selected from the group consisting of cellulose acetate, cellulose butylate, polyesters, polyethers, polyurethanes, nitrocellulose, poly(vinyl alcohol), glycidyl azide polymers, thermoplastic elastomers, and thermoset elastomers; and a stabilizer, wherein the amounts of the ammonium nitrate, the activated carbon, and the stabilizer are from 89 to 99 wt %, from 1 to 6 wt %, and from 0.2 to 6 wt %, respectively, with respect to the total amount of the ammonium nitrate, the activated carbon and the stabilizer, thereby the gas generating composition produces substantially no carbon monoxide when burned.

24. The gas generating composition as recited in claim 23, wherein the activated carbon has an average particle size of 3 to 50 μm and has a specific surface of 50 to 1300 $m^2/g$.

25. The gas generating composition as recited in claim 23, wherein the stabilizer is at least one selected from the group consisting of diphenylamine, resorcinol, and diethyldiphenyl urea.

26. The gas generating composition as recited in claim 23, wherein the amount of the binder in the gas generating composition is 25 wt % or less.

27. A gas generating composition for use with an airbag device or a seat belt pretensioner apparatus essentially consisting of:

ammonium nitrate as an oxidizing agent;

activated carbon having an average particle size of 0.1 to 500 μm and having a specific surface of 5 to 1600 $m^2/g$ as a reducing agent;

a high-energy-compound selected from the group consisting of trimethylene trinitroamine, tetramethylene tetranitroamine, pentaerythritol tetranitrate, triaminoguanidinenitrate), and hydrazine nitrate;

a binder selected from the group consisting of cellulose acetate, cellulose butylate, polyesters, polyethers, polyurethanes, nitrocellulose, poly (vinyl alcohol), glycidyl azide polymers, thermoplastic elastomers, and thermoset elastomers; and a stabilizer, wherein the amounts of the ammonium nitrate, the activated carbon, and the stabilizer are from 89 to 99 wt %, from 1 to 6 wt %, and from 0.2 to 6 wt %, respectively, with respect to the total amount of the ammonium nitrate, the activated carbon and the stabilizer, thereby the gas generating composition produces substantially no carbon monoxide when burned.

28. The gas generating composition as recited in claim 27, wherein the activated carbon has an average particle size of 3 to 50 μm and has a specific surface of 50 to 1300 $m^2/g$.

29. The gas generating composition as recited in claim 27, wherein the stabilizer is at least one selected from the group consisting of diphenylamine, resorcinol, and diethyldiphenyl urea.

30. The gas generating composition as recited in claim 27, wherein the amount of the high-energy compound in the gas generating composition as 15 wt % or less.

31. The gas generating composition as recited in claim 27, wherein the amount of the binder in the gas generating composition is 25 wt % or less.

* * * * *